US010165367B2

(12) United States Patent
Lopez

(10) Patent No.: US 10,165,367 B2
(45) Date of Patent: Dec. 25, 2018

(54) CURVILINEAR ELONGATE NESTED SPEAKER SYSTEM

(71) Applicant: Carlos A. Lopez, Miami, FL (US)

(72) Inventor: Carlos A. Lopez, Miami, FL (US)

( * ) Notice: Subject to any disclaimer, the term of this patent is extended or adjusted under 35 U.S.C. 154(b) by 0 days.

(21) Appl. No.: 14/469,525

(22) Filed: Aug. 26, 2014

(65) Prior Publication Data

US 2015/0078579 A1 Mar. 19, 2015

Related U.S. Application Data

(63) Continuation-in-part of application No. 29/466,965, filed on Sep. 13, 2013, now abandoned.

(51) Int. Cl.
*H04R 1/02* (2006.01)
*H04R 5/02* (2006.01)

(52) U.S. Cl.
CPC ..... *H04R 5/02* (2013.01); *H04R 1/026* (2013.01); *H04R 1/028* (2013.01); *H04R 2201/023* (2013.01); *H04R 2201/028* (2013.01); *H04R 2420/07* (2013.01)

(58) Field of Classification Search
None
See application file for complete search history.

(56) References Cited

U.S. PATENT DOCUMENTS 4,571,740 A 2/1986 Kirby et al.
4,817,191 A 3/1989 Adams
5,235,822 A 8/1993 Leonovich, Jr.
5,416,283 A 5/1995 Dault et al.
D378,590 S * 3/1997 Zeitman ..... D14/165
6,163,508 A * 12/2000 Kim ..... G11B 20/00007 369/25.01
6,243,260 B1 6/2001 Lundgren et al.
D451,487 S * 12/2001 Ng ..... D14/168
D475,360 S * 6/2003 Yoneda ..... D14/168
6,587,403 B1 * 7/2003 Keller ..... G11B 17/22 369/30.05
D491,167 S * 6/2004 Yokoyama ..... D14/215
D515,066 S * 2/2006 Takagi ..... D14/168
D522,996 S * 6/2006 Takagi ..... D14/168
D526,992 S * 8/2006 Sakai ..... D14/168
D529,895 S * 10/2006 Hirano ..... D14/168
D534,895 S * 1/2007 Hirano ..... D14/168
D585,424 S * 1/2009 Yoneda ..... D14/216
(Continued)

OTHER PUBLICATIONS

Kaleidos Cooler, Design U.S. Appl. No. 29/466,965, filed Sep. 13, 2013, Carlos A. Lopez.

*Primary Examiner* — Tan X Dinh
(74) *Attorney, Agent, or Firm* — Richard C. Litman

(57) ABSTRACT

The nested speaker system includes a speaker unit selectively mounted inside a mounting nest. The mounting nest can be installed in various items such as coolers, bags, appliances, and furniture. The speaker unit can be interchangeably seated into various mounting nests. The speaker unit is provided with a mounting rib around opposite ends of a housing, and the mounting nest includes a corresponding mounting groove for the respective mounting rib along an interior periphery to securely seat the speaker unit when assembled. The speaker unit utilizes wireless transmissions from media players to stream audio files. Auxiliary inputs can be provided to facilitate playback of audio from other sources.

18 Claims, 6 Drawing Sheets

(56) References Cited

U.S. PATENT DOCUMENTS

| | | | |
|---|---|---|---|
| 7,722,204 | B1 | 5/2010 | Sandberg |
| 2006/0178172 | A1 | 8/2006 | Yuen |
| 2008/0025544 | A1 | 1/2008 | Maldonado |
| 2009/0089931 | A1 | 4/2009 | Vandenbelt |
| 2010/0202650 | A1 | 8/2010 | Park |
| 2010/0263398 | A1 | 10/2010 | Webb |
| 2012/0294550 | A1 | 11/2012 | Hassman et al. |
| 2013/0156251 | A1 | 6/2013 | Noble |
| 2013/0259283 | A1 | 10/2013 | Gengler et al. |

* cited by examiner

CURVILINEAR ELONGATE NESTED SPEAKER SYSTEM

CROSS-REFERENCE TO RELATED APPLICATIONS

This application is a continuation-in-part of U.S. Design patent application Ser. No. 29/466,965, filed Sep. 13, 2013.

BACKGROUND OF THE INVENTION

1. Field of the Invention

The present invention relates to personal audio systems, and particularly to a modular, nested speaker system configured for easy removable installation and use in a variety of items.

2. Description of the Related Art

Many enjoy listening to a variety of audio media such as music, audio books, periodicals, podcasts, lectures, radio theater, and others that suit an individual's tastes. The current advances in electronics and computer technology have resulted in a myriad of devices and options that allow one to enjoy the audio media of choice practically anywhere. One of the most ubiquitous devices utilized for such purposes is the smartphone.

Current smartphones are capable of many different functions besides the typical ability to make and receive phone calls and texting over cellular networks. The smartphone is technically a small, portable computing device with sufficient processing power to run many different applications. A common, if not staple, functionality of most smartphones is the ability to play a variety of audio and visual media in various file formats. The user usually enjoys such entertainment through headphones plugged into an appropriate jack on the smartphone.

While headphones provide the user with audio quality close to that of conventional speakers, there are instances when the user may desire to experience the audio media through conventional speakers without being tethered to the cords of a typical headphone. The speaker or speakers on the typical smartphone do not suffice due to the relatively tiny size and the inherent inability to reproduce the fullness of sound and staging of most conventional speakers without sounding tinny. The user could purchase wireless headphones so that he or she is unencumbered by the typical headphone cords, but wireless headphones tend to be relatively expensive, limited in range, and not entirely reliable in maintaining a constant wireless connection at certain distances.

Due to some of the limitations mentioned above, many speaker systems have been developed to meet those types of demands for an audio solution. Most conventional speaker systems are provided as rectangular or cylindrical devices with one or more speakers therein. Some include a dock with a plug to facilitate a hard connection between the speaker system and a media player, such as the smartphone, tablets, MP3 players, and the like. Others utilize Bluetooth® technology so that the user can stream music and other audio media from the media player to the speaker system. The latter is very convenient for most users due to the remote control functionality of controlling the speaker system from the media player.

Most of these Bluetooth-enabled speaker systems, however, tend to be standalone portable devices that simply serve as audio output for the media player. Many of these systems lack additional versatility, such as being able to be incorporated or stowed into other appliances, furniture, or common items and become part of the same.

In light of the above, there is still a need for a portable speaker system that can be interchangeably mounted to various items in a secure manner for listening enjoyment anywhere by the user. Thus, a nested speaker system solving the aforementioned problems is desired.

SUMMARY OF THE INVENTION

The nested speaker system includes a speaker unit selectively mounted inside a mounting nest. The mounting nest can be installed in various items such as coolers, bags, appliances, and furniture. The speaker unit can be interchangeably seated into various mounting nests. The speaker unit is provided with a mounting rib around opposite ends of a housing, and the mounting nest includes a corresponding mounting groove for the respective mounting rib along an interior periphery to securely seat the speaker unit when assembled. The speaker unit may utilize wireless transmissions from media players to stream audio files. Auxiliary inputs can be provided to facilitate playback of audio from other sources.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
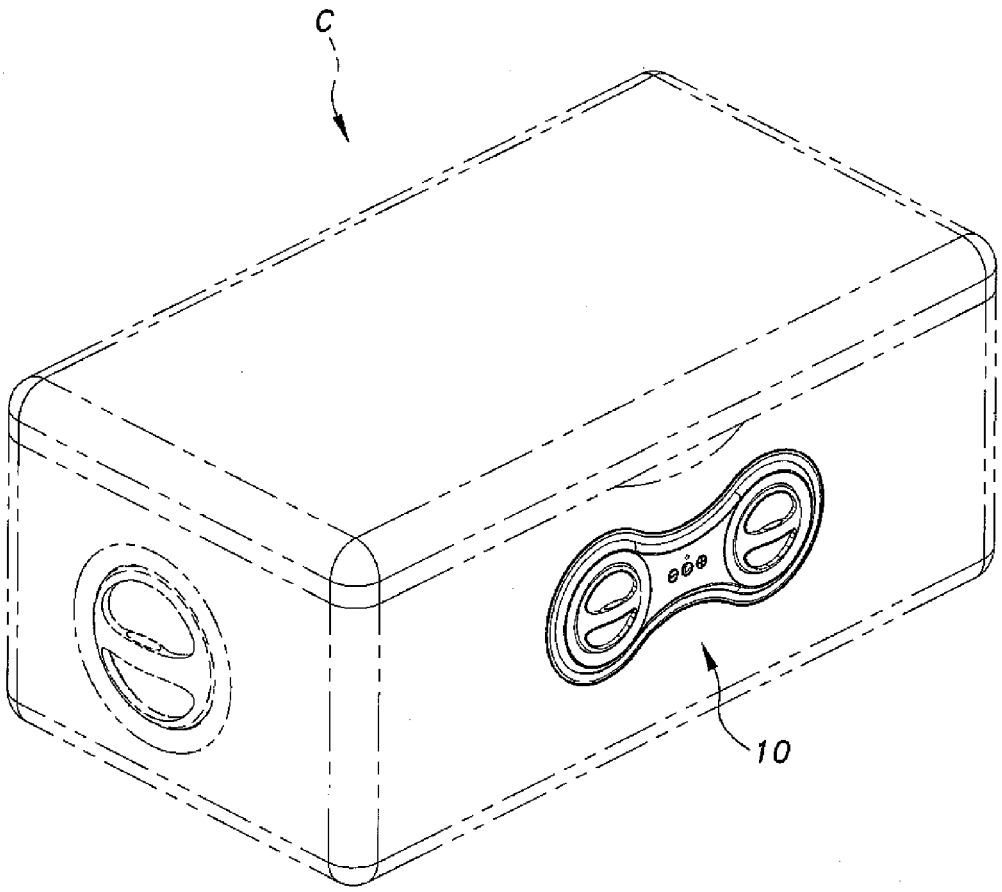
FIG. 1A is an environmental, perspective view of a nested speaker system according to the present invention, the nested speaker system being mounted to a cooler.

The nested speaker system, generally referred to by the reference number 10 in the drawings, provides a versatile, portable audio output device that can be interchangeably installed in various items for convenient listening enjoyment and use with a wide variety of media players. As best seen in FIGS. 1A, 1B, 2A, and 2B, the nested speaker system 10 includes a speaker assembly or unit 20 detachably mounted to a mounting receptacle or nest 40.

The speaker unit 20 includes a substantially elongate housing 21 having a front 22, a back 23, and a curvilinear sidewall 24 extending between the front 22 and back 23 around the periphery thereof. The housing 21 is preferably curvilinear or bilaterally ellipsoid in shape so as to form bulbous or substantially rounded sections 25 at opposite ends.

Each rounded section 25 includes an opening housing a speaker 26. Each speaker 26 is covered by a speaker grill 26*a* to substantially protect the speaker 26 from the environment, such as dust, liquid, debris, foreign objects, and the like. The speaker 26 is mounted inside the rounded section 25 below or beneath the speaker grill 26*a* in a conventional manner known in the art. An annular flange 26*b* surrounds the circumferential periphery of the speaker 26 so as to form a reinforcement ring around the corresponding speaker 26. Most speakers include a surround, which moves with and centers the driver cone when the driver cone reciprocates to generate sound waves. The flange 26*b* can be constructed to provide space for movement of the surround within the rounded section 25. The flange 26*b* also defines the opening for the speaker 26 through which sound can propagate from the speaker 26. One speaker may be a bass speaker, and the other speaker may be a treble speaker, each speaker being optimized according to the frequency range of the audio.

A cap 27 is rigidly attached to the inner periphery of each flange 26*b*. The cap 27 is preferably an annular ring having an elongate, substantially curved handle 27*a* extending diametrically across the annular ring, forming upper and lower semicircular openings or cutouts 27*c*. Each handle 27*a* can be provided with upper and lower grip sections 27*b* to enhance manual operation of the handle 27*a*. The grip sections 27*b* can be constructed from the same material as the handle 27*a*. However, the grip sections 27*b* are preferably constructed from resilient, grip enhancing materials, such as rubber, elastomeric polymers, silicone, and the like. Moreover, the grip sections 27*b* can be textured, such as by raised protrusions of various shapes or otherwise patterned to further enhance gripping characteristics thereof.

The handles 27*a* facilitate easy grasping of the speaker unit 20 to selectively mount or remove the speaker unit 20 to or from the mounting nest 40. The cutouts 27*c* provide room for the user's fingers to grab the handle 27*a* while the grip sections 27*b* enhance the grip for the user to securely push or pull the speaker unit 20 during the mounting or removal process. The curved shape of the handles 27*a* also elevates the same above the speaker grill 26*a* so that each handle 27*a* will not potentially damage the speaker grill 26*a*. Moreover, the curved shape of the handles 27*a* decreases risks of damage from external forces. The overall shape of the perforated cap 27 is preferably rounded, similar to a chordal segment of a sphere with the upper and lower cutouts 27*c* forming or defining the corresponding handle 26*a*.

The front 22 of the speaker unit 20 can also include an interface 28 for controlling at least some basic functions, such as playback, volume, and power activation, which will be further detailed below. The interface 28 can be provided with at least one button 28*a* to facilitate the various operations. A visual indicator, such as an LED (light emitting diode) light 28*b*, can be provided near the interface 28 to illuminate in response to various inputs. The nature of the response can be various patterns of ON and OFF states, colors, and/or intensity.

The speaker unit 20 also includes additional operating features on the back 23 for power and auxiliary inputs. The speaker unit 20 is preferably powered by a rechargeable battery or batteries. However, the speaker unit 20 can also be provided with a compartment for conventional replaceable batteries in a manner known in the art, if desired. It is noted, however, that either or both types of battery power can be incorporated into the speaker unit 20.

The back 23 of the speaker unit 20 can include a power switch 23*a*, at least one USB (universal serial bus) port 23*b*, and a jack 23*c*. The power switch 23*a* can be the primary means of selectively powering the speaker unit 20, the switch being slidable between ON and OFF states. The USB port 23*b* can be provided in various standards of USB, such as USB 2.0, USB 3.0, mini-USB, micro-USB, and the like. The USB port 23*b* facilitates recharging the battery, as well as processing data between the speaker unit 20 and other devices, such as a computer, a laptop, or a handheld device, such as a smartphone, tablet, MP3 player, or media player with a compatible USB connector. Moreover, external storage devices, such as external hard drives, thumb drives, and the like containing playable files can also be connected to the USB port 23*b* for subsequent playback through the speaker unit 20. The jack 23*c* is preferably a standard 3.5 mm jack for connecting auxiliary devices, such as the computers and handheld devices mentioned above, that utilize 3.5 mm plugs. The jack 23*c* can also be a power port for connecting the speaker unit 20 to a standard wall outlet or to a source of AC power as another means of supplying power to the speaker unit 20.

The speaker unit 20 can be used alone as a speaker detached from the mounting nest 40. When used in such a manner, it is desirable to have the speaker unit 20 stably supported on whatever surface the speaker unit 20 rests. To facilitate such support, the housing 21 includes a beveled or sloped support edge 29 at the bottom of each rounded section 25. In addition to providing a flat or planar surface for supporting the speaker unit 20, the beveled support edge 29 also cants the speaker unit 20 at a relatively small angle with respect to the resting surface to direct sound at a generally non-horizontal angle. This arrangement eliminates some of the potentially undesirable distortions that can occur from unintentional reflected sound.

Figure 1B:
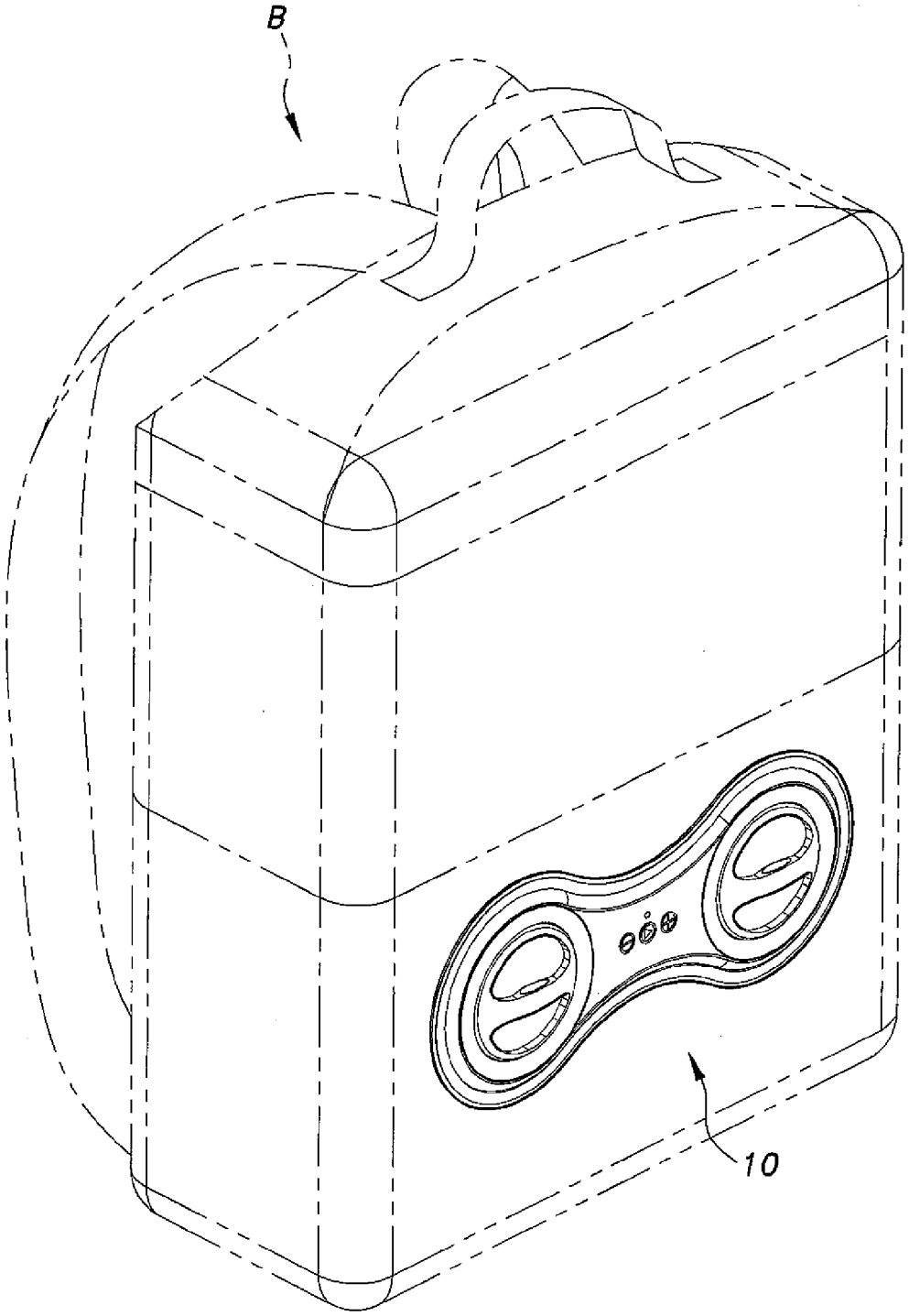
FIG. 1B is an environmental, perspective view of the nested speaker system according to the present invention, the nested speaker system being mounted to a backpack.

In most instances, it is envisioned that the speaker unit 20 will be utilized in conjunction with the mounting nest 40 to facilitate interchangeable installation into a variety of items while providing a member for secure storage and retention of the speaker unit 20. As best seen in FIGS. 1A and 1B, some of the items where the nested speaker system 10 can be mounted are a cooler C and a backpack B. Other items that can accommodate the nested speaker system 10 include tote bags, refrigerators, lamps, cabinets, furniture, walls, and the like.

Figure 2A:
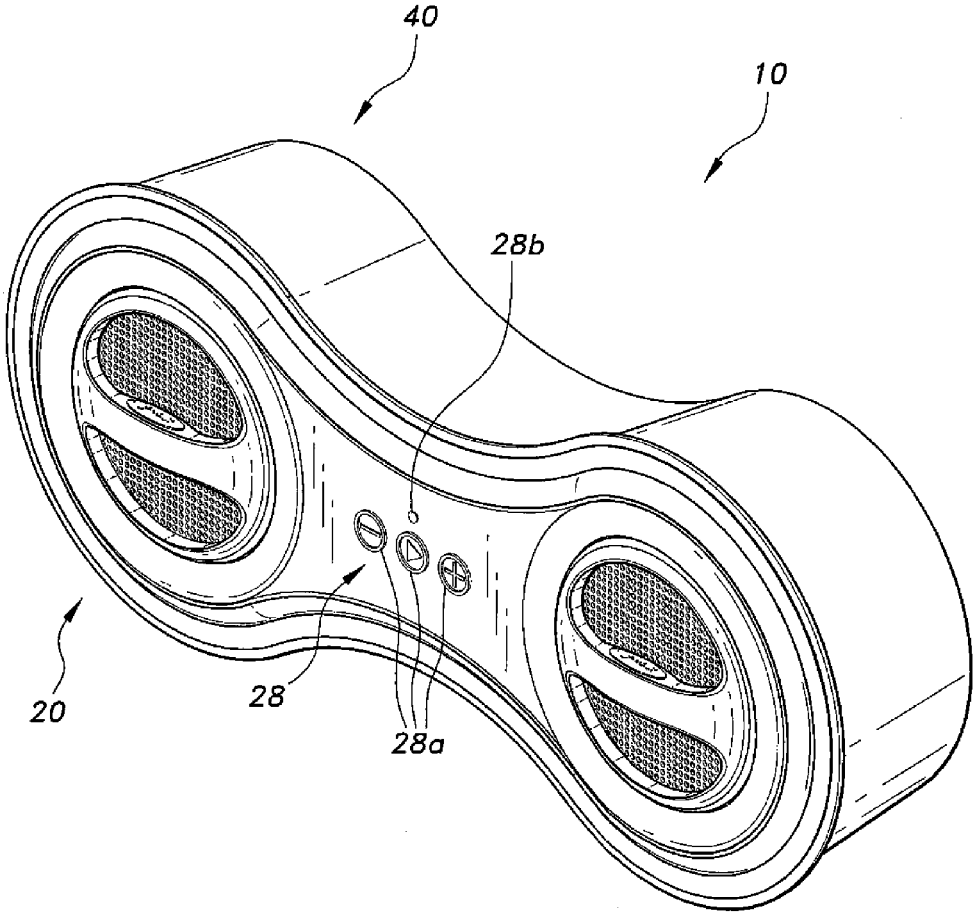
FIG. 2A is a perspective view of the nested speaker system shown in FIGS. 1A and 1B.
Figure 2B:
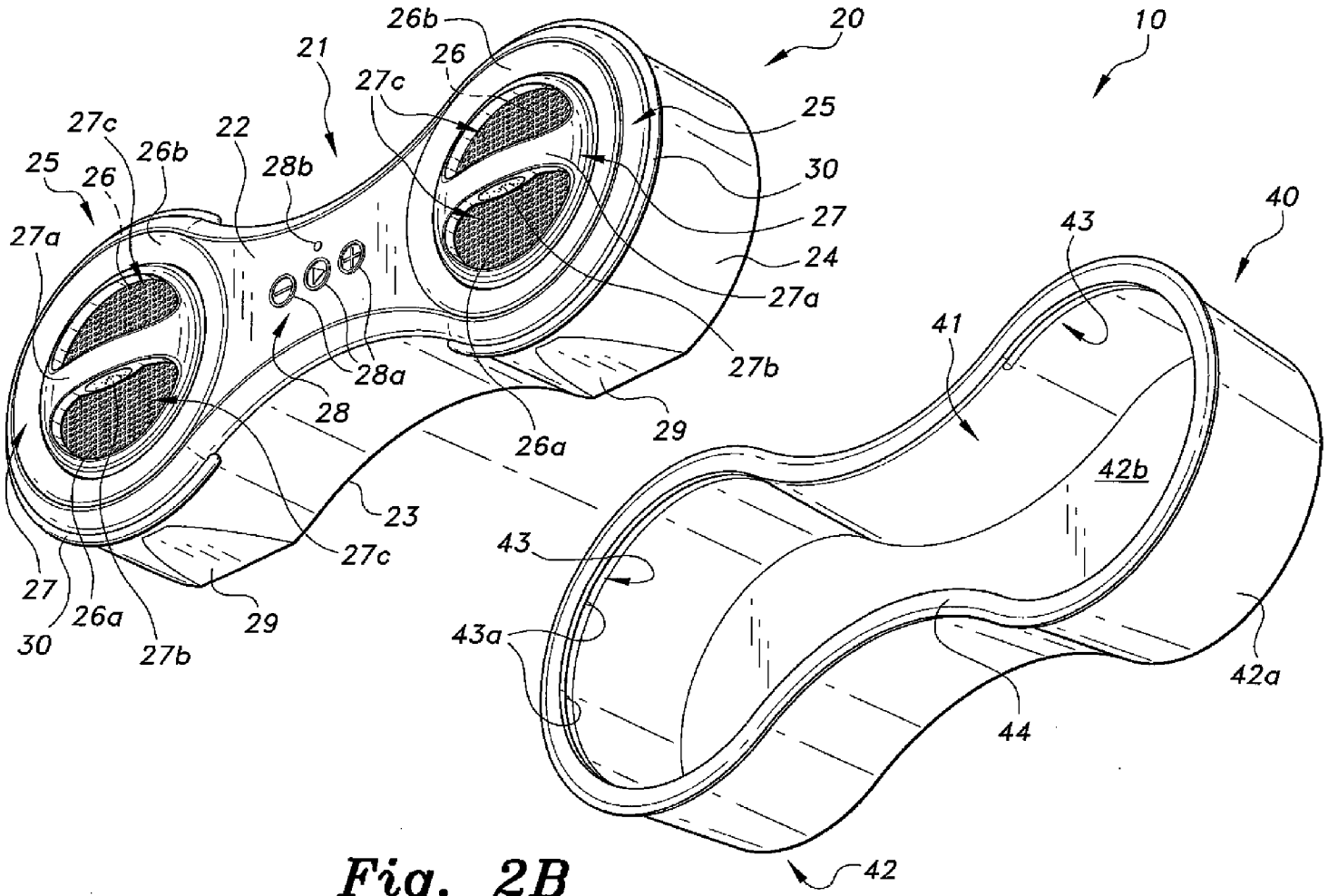
FIG. 2B is an exploded perspective view of the nested speaker system shown in FIG. 2A.
Figure 3:
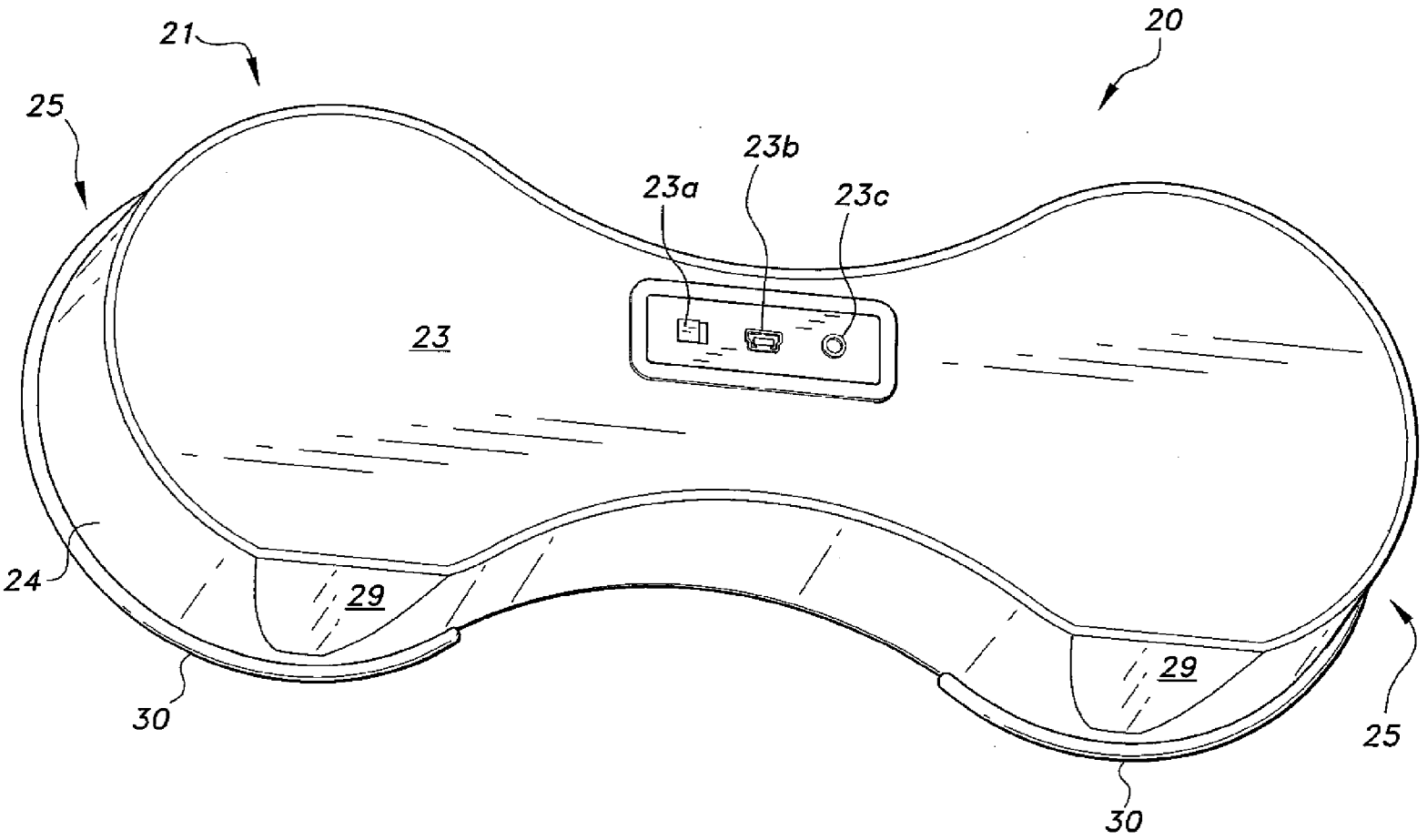
FIG. 3 is a rear view of the speaker assembly in the nested speaker system shown in FIG. 2A.

Referring to FIG. 2B, the mounting nest 40 includes an elongate, open shell or bracket 42 having a similar, substantially bilateral ellipsoid shape as that of the housing 21. The mounting nest 40 can also be referred to as a mounting adapter. The open bracket 42 is formed by a curvilinear sidewall 42*a* and a back 42*b*, the back 42*b* defining the closed end of the open bracket 42. The open front 41 opposite the back 42*b* provides space for selective insertion and removal of the speaker unit 20. The shape of the open bracket 42 is preferably the same as the speaker unit 20 so that the speaker unit 20 can be slidably mounted to the mounting nest 40 in a mating relationship.

To insure that the speaker unit 20 is securely seated in the mounting nest 40, the nested speaker system 10 includes a retention assembly. The retention assembly includes at least one mounting rib 30 on the speaker unit 20 and at least one mounting groove 43 defined in the mounting nest 40. Each mounting rib 30 is an elongate strip of resilient material extending around a substantial portion of the periphery on the outer surface of the respective rounded section 25, the mounting rib 30 being disposed slightly below the front 22 towards the back 23. Each mounting groove 43 is a corresponding curved or arcuate groove formed along the inner periphery of the open bracket 42 near the open end 41, the curvature being substantially similar to the mounting rib 30 so that the mounting rib 30 seats relatively firmly therein. Each mounting groove 43 can be provided with one or more recessed ribs 43*b* to reinforce the mounting groove 43 to prevent undesirable deformation from repeated use that can potentially degrade retention of the respective mounting rib 30. Due to this construction, the mounting rib 30 is preferably constructed from silicone, which exhibits durable resilient characteristics, as well as providing increased friction, which assists in maintaining a relatively strong connection that prevents the speaker unit 20 from disengagement with the mounting nest 40. Other similar materials, such as elastomeric polymers, rubber, and the like, can be utilized for similar functionality. A lip or flange 44 extends outward along the periphery of the open end 41. The lip 44 forms an abutment that prevents insertion of the mounting nest 40 into the item past the front or open end 41. Moreover, the lip 44 covers the opening on the item to present a substantially flush face of the nested speaker system 10 thereon. The lip 44 can also be used to permanently mount the mounting nest 40 to the item via adhesives or fasteners.

In use, the nested speaker system 10 is mounted to an item, such as the cooler C, backpack B, or other items with an opening to seat the mounting nest 40. The speaker system 10 utilizes wireless technology that allows users to stream music and other audio media to the speaker unit 20. An example of the system to facilitate the streaming will be further described below. The mounting nest 40 permits the speaker unit 20 to be interchangeably mounted to various items. For example, the user can remove the speaker unit 20 from the cooler C and seat the same speaker unit 20 to the backpack B, and vice versa. Thus, it can be seen that the nested speaker system 10 is versatile in function and form, having the ability to unobtrusively blend in with the user's environment via the items to which the nested speaker system 10 is mounted. The nested speaker system 10 is modular to the extent that the nested speaker system 10 can be interchangeable with any of the items that accommodate a nested speaker system 10.

Figure 4:
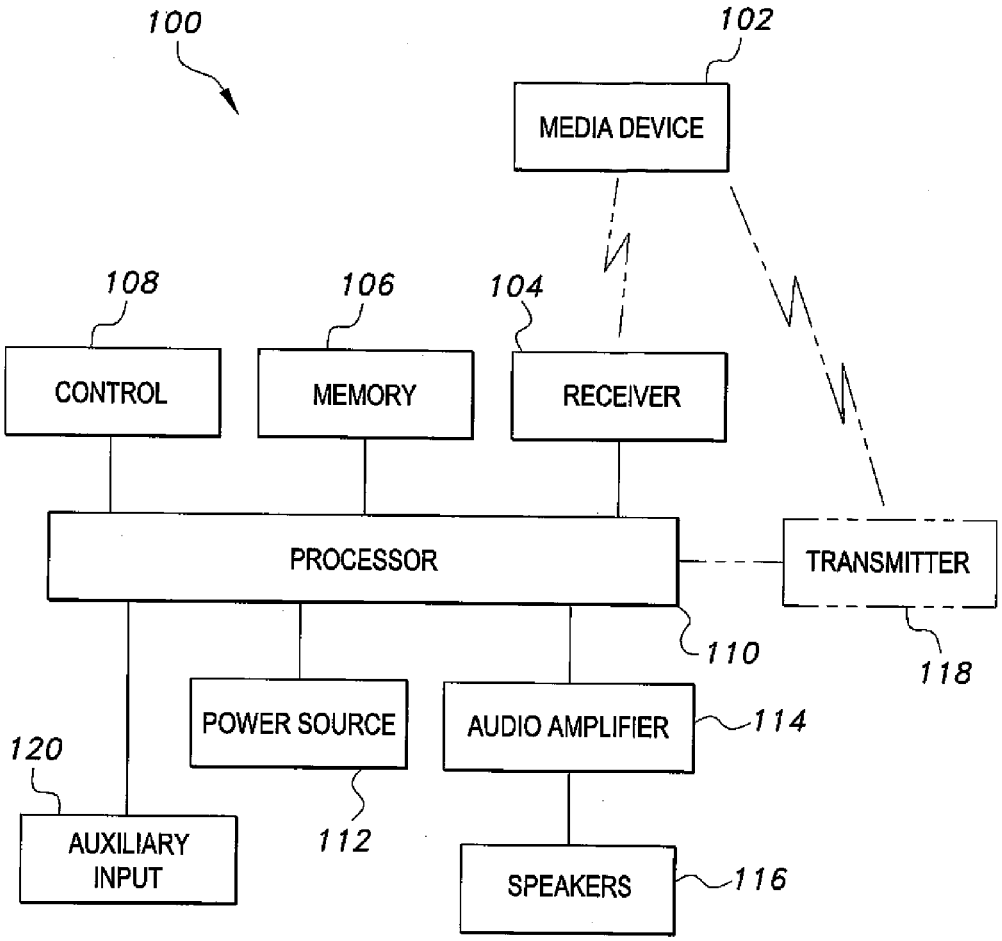
FIG. 4 is a block diagram of a nested speaker system according to the present invention.

Turning to FIG. 4, the system diagram 100 therein details some of the functions of the nested speaker system 10. In use, the user operates a media device 102, such as a smartphone or MP3 player, to wirelessly transmit the audio file to be played. The wireless signals can be provided via Bluetooth®, conventional radio frequency, infrared, and the like. The signals are received by a receiver 104, which then sends the data to the processor 110.

A memory 106 can be connected to the processor 110, and the memory 106 can store one or more programs that convert the data into a playable format or signal. The memory 106 can also temporarily store or buffer the incoming data to provide the processor 110 with time to process the data for output.

The processor 110 transmits the data to the audio amplifier 114, which amplifies the signals prior to transmission to the speakers 116, such as the speaker 26. The amplification boosts the signal strength to a desired or predefined level sufficient to drive the speaker 26 for accurate or desired sound reproduction.

The main control of the nested speaker system 10 is provided by the media device 102. Most media devices 102 include an application via software that allows the user to manipulate and edit the audio files, facilitate volume and equalizer adjustments, and/or adjust stereo or mono functions. Any of these adjustments and controls during streaming will be reflected by the speaker unit 20. However, at least some basic controls can be facilitated independently with the control 108. The control 108 includes input from the buttons 28*a*. Selective operation of the buttons 28*a* can facilitate selective playback of the desired audio file, volume adjustments, selection of next or previous audio files, and/or searching for the desired section of the file. Due to the capabilities of Bluetooth® technology, the system 100 can include a transmitter 118, which communicates with the media device 102 to synchronize the operations facilitated through the control 108. A power source 112 is coupled to the processor 110 and provides power for all the operations of the system 100. The power source 112 can include, but is not limited to, rechargeable batteries, replaceable batteries, and AC from an outlet.

The system 100 can also include an auxiliary input 120. The auxiliary input 120 permits other sources of audio to connect to the speaker unit 20, for example, through the USB port 23*b* and/or jack 23*c*. These connections are hard wire connections that do not utilize wireless technologies. As such, the other sources of audio can be a personal computer through an appropriate USB cable, and generally older media players that do not include wireless capabilities.

It is to be understood that the nested speaker system 10 encompasses a variety of alternatives. For example, the nested speaker system 10 can be provided in various coordinated colors that the user can mix and match as desired. Additionally, indicia can be placed at select locations to indicate information such as manufacturer, company logo, personal names, specifications, and the like. The nested speaker system 10 is preferably constructed from durable plastic. However, other materials, such as wood, metal, composites, and combinations thereof can also be used. The speaker unit 20 can also be provided with different or additional speakers, such as a sub-woofer or multi-way drivers to increase the dynamic range compared to a single driver.

It is to be understood that the present invention is not limited to the embodiments described above, but encompasses any and all embodiments within the scope of the following claims.

I claim:

1. A nested speaker system, comprising:

a mounting nest adapted to be selectively installed in an item, the mounting nest having:

a substantially elongate, open bracket having an open front, a closed back, and a curvilinear sidewall extending between the open front and closed back, the curvilinear sidewall defining a generally curvilinear periphery; and a lip extending outward from the periphery of the open front, the lip forming an abutment preventing slidable mounting of the mounting nest past the open front;

a speaker unit adapted to be selectively seated inside the mounting nest through the open front of the open bracket, the speaker unit having;

a substantially elongate housing, the housing having a front, a back, and a curvilinear sidewall extending between the front and back, the curvilinear sidewall defining a generally curvilinear periphery substantially similar to the curvilinear periphery of the open bracket, the housing defining a rounded section at opposite ends of the housing, each of the rounded sections having at least one speaker mounted therein, a speaker grill covering the respective at least one speaker, and a cap covering each speaker grill, the cap having a handle adapted to be grasped by a user during selective seating of the speaker unit to the mounting nest;

an interface disposed on the front of the housing, the interface having inputs for controlling the speaker unit; and connector ports on the back of the housing;

a retention assembly disposed between the mounting nest and the speaker unit, the retention assembly securely seating the speaker unit inside the mounting nest and preventing inadvertent disengagement of the speaker unit from the mounting nest; and a control system to facilitate selective playback of audio files from media players through the speaker unit.

2. The nested speaker system according to claim 1, wherein said curvilinear shape comprises a substantially bilateral ellipsoid.

3. The nested speaker system according to claim 1, wherein said retention assembly comprises:

a resilient mounting rib extending around a substantial, outer peripheral portion of each said rounded section of said housing, each of the mounting ribs defining a curvature; and a curved groove formed inside an inner periphery of said open bracket at opposite inner ends thereof, each of the curved grooves having a curvature substantially the same as the respective mounting rib, each of the curved grooves selectively receiving a corresponding mounting rib.

4. The nested speaker system according to claim 3, wherein each said curved groove further comprises at least one recessed rib disposed therein, the at least one recessed rib for reinforcing the respective curved groove and for preventing deformation thereof from repeated use.

5. The nested speaker system according to claim 1, wherein each said rounded section further comprises an annular flange surrounding the respective speaker grill.

6. The nested speaker system according to claim 1, wherein said cap comprises an annular ring, an upper semicircular cutout, and a lower semicircular cutout, said handle extending diametrically across the annular ring between the upper semicircular cutout and the lower semicircular cutout.

7. The nested speaker system according to claim 6, wherein said handle is curved in order to be spaced from said speaker grill.

8. The nested speaker system according to claim 7, further comprising at least one grip disposed on each said handle.

9. The nested speaker system according to claim 1, further comprising a beveled support edge formed at a bottom of each said rounded section to provide a stable support for the speaker unit on a resting surface.

10. The nested speaker system according to claim 1, wherein said inputs comprises a plurality of buttons.

11. The nested speaker system according to claim 10, further comprising at least one indicator light disposed near said inputs, the indicator light illuminating selectively in response to said inputs.

12. The nested speaker system according to claim 1, wherein said connector ports comprise at least one USB port and at least one jack.

13. The nested speaker system according to claim 12, further comprising a power switch disposed on the back of said housing.

14. The nested speaker system according to claim 1, wherein said control system comprises:

a receiver for receiving wireless transmissions from a media device;

a processor coupled to the receiver for processing the transmissions;

a control coupled to the processor for relaying operations from said inputs;

a power source coupled to said speaker unit to provide power for operations; and an audio amplifier connected to the processor to amplify the transmissions and transmit audio signals to said at least one speaker.

15. The nested speaker system according to claim 14, wherein said control system further comprises a transmitter for transmitting wireless signals between said processor and the media device.

16. The nested speaker system according to claim 14, wherein said control system further comprises memory coupled to the processor.

17. The nested speaker system according to claim 14, wherein said control system further comprises an auxiliary input coupled to said connector ports and said processor, the auxiliary input facilitating hard connection and playback processing of other media players.

18. The nested speaker system according to claim 14, wherein said power source is selected from a group consisting of rechargeable batteries, replaceable batteries, and AC power.

* * * * *